US011519424B2

(12) United States Patent
Engert et al.

(10) Patent No.: US 11,519,424 B2
(45) Date of Patent: Dec. 6, 2022

(54) RETURN CHANNELS FOR A MULTI-STAGE TURBOCOMPRESSOR

(71) Applicant: ebm-papst Mulfingen GmbH & Co. KG, Mulfingen (DE)

(72) Inventors: Markus Engert, Lauda-Königshofen (DE); Angelika Klostermann, Gaisbach (DE); Daniel Conrad, Langenbrettach (DE)

(73) Assignee: ebm-papst Mulfingen GmbH & Co. KG, Mulfingen (DE)

( * ) Notice: Subject to any disclaimer, the term of this patent is extended or adjusted under 35 U.S.C. 154(b) by 14 days.

(21) Appl. No.: 16/685,147

(22) Filed: Nov. 15, 2019

(65) Prior Publication Data

US 2020/0080569 A1 Mar. 12, 2020

Related U.S. Application Data

(63) Continuation of application No. PCT/EP2018/064772, filed on Jun. 5, 2018.

(30) Foreign Application Priority Data

Jun. 27, 2017 (DE) ..... 10 2017 114 232.0

(51) Int. Cl.
*F04D 29/44* (2006.01)
*F04D 17/12* (2006.01)
*F04D 29/30* (2006.01)

(52) U.S. Cl.
CPC ..... *F04D 29/444* (2013.01); *F04D 17/122* (2013.01); *F04D 29/30* (2013.01)

(58) Field of Classification Search
CPC ..... F04D 29/44; F04D 29/444; F04D 17/12; F04D 17/122; F04D 29/30
See application file for complete search history.

(56) References Cited

U.S. PATENT DOCUMENTS 2,748,713 A * 6/1956 Buchi ..... F04D 29/445 415/187
2,900,126 A 8/1959 Dangerfield
(Continued)

FOREIGN PATENT DOCUMENTS

CH 331941 A 8/1958
EP 2 918 848 A1 9/2015
(Continued)

OTHER PUBLICATIONS

Kurt Prevedel, "Machine Translation of W02016149728", Sep. 9, 2016 (Year: 2016).*
(Continued)

*Primary Examiner* — Topaz L. Elliott
*Assistant Examiner* — Michael K. Reitz
(74) *Attorney, Agent, or Firm* — Harness, Dickey & Pierce, P.L.C.

(57) ABSTRACT

A return geometry fluidically connects a first and a second compressor stage of the turbocompressor. The return geometry has multiple partial helices that are evenly or unevenly distributed in the circumferential direction. The multiple partial helices extend at least in part in the circumferential direction. They form flow channels that extend at least in some sections, separately from each other, to fluidically connect the first and second compressor stages.

14 Claims, 6 Drawing Sheets

(56) References Cited

U.S. PATENT DOCUMENTS

| | | | | | |
|---|---|---|---|---|---|
| 3,171,353 | A * | 3/1965 | McMahan | F04D 25/0606 | 415/199.3 |
| 4,531,356 | A * | 7/1985 | Linder | F04D 29/4213 | 60/726 |
| 6,062,028 | A * | 5/2000 | Arnold | F04D 29/4206 | 417/407 |
| 6,540,481 | B2 * | 4/2003 | Moussa | F04D 29/441 | 415/208.2 |
| 8,181,462 | B2 * | 5/2012 | Arnold | F01D 5/048 | 60/612 |
| 2007/0003662 | A1 | 1/2007 | Chiba | | |
| 2007/0036662 | A1 * | 2/2007 | Pesola | F04D 17/12 | 417/350 |
| 2010/0319343 | A1 * | 12/2010 | Arnold | F02B 37/007 | 60/605.1 |

FOREIGN PATENT DOCUMENTS

| | | | |
|---|---|---|---|
| EP | 30 56 741 | A1 | 8/2016 |
| GB | 854127 | * | 6/1957 |
| WO | WO-2016/149728 | A1 | 9/2016 |

OTHER PUBLICATIONS

German Search Report (in German) dated Jun. 26, 2018 in corresponding German Application No. 10 2017 114 232.0.

International Search Report and Written Opinion (in German) dated Sep. 10, 2018 in corresponding PCT International Application No. PCT/EP2018/064772.

* cited by examiner

RETURN CHANNELS FOR A MULTI-STAGE TURBOCOMPRESSOR

CROSS-REFERENCE TO RELATED APPLICATIONS

This application is a continuation of International Application No. PCT/EP2018/064772, filed Jun. 5, 2018, which claims priority to German Application No. 10 2017 114 232.0, filed Jun. 27, 2017. The disclosures of the above applications are incorporating herein by reference.

FIELD

The disclosure relates to a return geometry of a turbocompressor for optimally fluidically connecting a first and a second compressor stage of the turbocompressor.

BACKGROUND

Solutions for connecting the first and second compressor stages in turbocompressors are known in the prior art. Here, return geometry and rotationally symmetrical return channels are used.

They usually consist of a return geometry that is arranged after the compressor impeller of the first compressor stage. For example, a 180° bend, a radial nozzle usually provided with guide wheels and a 90° deflection for the entry into the region of the subsequent compressor impeller. A corresponding design is known, for example, from the published document EP 3056741 A1 or EP 2918848 A1.

In the turbocompressors known from the prior art, an undesired vortex occurs in the flow in the first compressor stage. In addition, the inflow into the second compressor stage is uneven. Moreover, it is disadvantageous that, at low mass flow rates, undesired flow separation can occur within the provided one rotationally symmetrical return channel. Furthermore, the pressure loss in the return channel is relatively high.

SUMMARY

Therefore, it is an object of the disclosure to provide a return geometry for a turbocompressor. The geometry reduces the risk of flow separation and minimizes the pressure loss.

This object is achieved by a turbocompressor return geometry fluidically connecting a first and a second compressor stage of the turbocompressor. The return geometry includes multiple partial helices evenly or unevenly distributed in the circumferential direction. The multiple partial helices extend at least in part in the circumferential direction. The multiple partial helices form flow channels that extend, at least in some sections, separately from each other to fluidically connect the first and second compressor stages.

According to the disclosure, a return geometry of a turbocompressor is proposed. It is designed to fluidically connect a first compressor stage and a second compressor stage of the turbocompressor. The return geometry has multiple partial helices that are evenly distributed in a circumferential direction. The helices extend at least in part in a circumferential direction. They form flow channels that extend at least in some sections separately from one another to fluidically connect the first and second compressor stages. The word part "geometry" is contained in "return geometry," but it is the formation of the flow channels that determines the resulting flow conduction.

The plurality of flow channels decreases the flow cross section of each individual flow channel. This provides an even inflow into the second compressor stage. In addition, the maximum width of extension, in particular in a radial direction, of each individual channel, compared to an individual rotationally symmetrical return channel, can be increased. In particular, in a radial direction, without extensive flow separation or return flow being observed at operating points with low mass flow.

In an advantageous embodiment, the flow channels form multiple successively arranged bends that multiply deflect the flow between the first and second compressor stages. In this manner it is possible to achieve, from a radial outflow direction of the compressor impeller of the turbocompressor in the first compressor stage, an optimal axial incident flow on the compressor impeller of the second compressor stage.

In a particularly advantageous embodiment of the return geometry, the bends of the flow channels guide the flow from a radial outflow direction first into a first axial direction in the direction of the second compressor stage and subsequently back into a radial inflow direction that runs counter to the outflow direction. In an even more advantageous design, subsequently to the inflow direction, the last bend of the flow channels, when viewed in flow direction, guides the flow subsequently into the inflow direction into a second axial radial direction that runs counter to the first axial direction. The second axial direction here corresponds to the suction direction of the compressor impeller of the second compressor stage. Thus, via the flow channels, a predefined inflow can occur precisely toward the suction region of the compressor impeller of the second compressor stage. Here, the bends generate a substantially 90° deflection in each case.

Depending on the design of the turbocompressor, the compressor impeller of the second compressor stage can be arranged in the same direction as the compressor impeller of the preceding compressor stage. Thus, the direction of the entry is the same in the two compressor impellers. In the same way, the two compressor impellers can also be arranged in opposite direction. They can be positioned in a so-called back-to-back arrangement that is mainly appropriate in two-stage turbocompressors. The outflow geometry of the second compressor stage, which is designed, for example, as a helix, and the subsequent outlet tube can be led through the region between the individual partial helices of the return geometry. In principle, the disclosure is not limited to two-stage turbocompressors but can also be applied to multi-stage embodiments.

In a development of the return geometry, the flow channels of the partial helices extend from an inlet region of the first compressor stage, in particular from the outlet region of the impeller of the first compressor stage, to an outlet region of the first compressor stage, in particular to the inlet region of the impeller of the second compressor stage. They merge in the outlet region to form a circumferentially symmetrical overall channel. The overall channel then forms the inflow for or into the second compressor stage. This works particularly advantageously in an embodiment where, after the bend that guides the flow into the second axial direction, that is after the last bend when viewed in flow direction, the flow channels merge in flow direction to form the overall channel.

Furthermore, an embodiment example of the return geometry is characterized in that, in a transition to the overall channel, the individual flow channels in each case have curved walls and/or curved vortex struts. The vortex struts are designed to impart to the flow, as it enters the overall channel, a predefined vortex that effectively promotes the suctioning through the compressor impeller of the second compressor stage.

For assisting the flow deflection, in an embodiment variant, the return geometry is designed in such a manner that the bend formed in each case in the flow channels, that deflects the flow from the radial outflow direction into the first axial direction in the direction of the second compressor stage, in each case includes a guide strut. The guide strut extends outward along the respective flow channel in radial direction and into the first axial direction. In an advantageous embodiment, the guide struts subdivide the respective flow channel in the center. Thus, the two remaining parts of the respective flow channel can be run through by identically large mass flow. In a further development, the guide struts extend radially outside of a tongue radius of the return geometry. They are spaced radially outward with respect to an inlet of the respective flow channel, that is formed by the tongue radius.

Moreover, in an embodiment of the return geometry that is fluidically advantageous, the flow channels have an axial section where the flow is guided into the first axial direction in the direction of the second compressor stage. The axial section of the flow channels is designed as a diffuser. The design of the respective axial section as a diffuser slows down flow, the friction losses are reduced, and static pressure builds up. The axial section of the return geometry advantageously runs parallel to a rotation axis of the turbocompressor.

In another advantageous embodiment of the return geometry, the flow channels have an inflow radial section that can be associated with the first compressor stage. An outflow radial section can be associated with the second compressor stage. The sections guide the flow in each case into the inflow direction or into the outflow direction, preferably axially, before the flowing fluid flows out of the return geometry. Fluidically, the design is advantageous here. The flow channels in the outflow radial section broaden with respect to their cross section in the flow direction. Thus, an acceleration of the flow in the outflow radial section is reduced or even prevented.

In a compact design, the flow channels of the partial helices of the return geometry are formed by a spacer housing of the turbocompressor. The spacer separates the first compressor stage from the second compressor stage. The flow channels can extend in the outer circumferential surface of the spacer housing. In a development, the flow channels of the partial helices are formed by the spacer housing and the turbocompressor housing. The flow channels are formed by a channel clearance between an outer surface of the spacer housing and an inner wall surface of the turbocompressor housing. For example, the flow channels extend in the outer circumferential surface of the spacer housing. They are covered by the turbocompressor housing. In alternative embodiments, the turbocompressor housing and the spacer housing can also be designed in multiple parts.

In a development of the return geometry, the spacer housing has an axial opening to receive the compressor impeller of the first compressor stage with an axial opening radius R1. The flow channels of the partial helices extend from the tongue radius R2 of the spacer housing. The tongue radius is set to be greater than the axial opening radius R1 by the factor of 1.4-1.8. An additional enlargement would entail the risk of the flow separation that is to be prevented.

In an embodiment variant of the return geometry, the partial helices extend at the inlet of the flow channels. This is determined by the tongue radius R2, at an angle a3=60°-80° with respect to a radial plane extending radially outward in the circumferential direction. The outflow direction of the compressor impeller of the first compressor stage and the inflow direction into the flow channels can be adjusted to one another with respect to the outflow angle and the inflow angle.

With regard to the size of the flow channels of the return geometry, in an advantageous embodiment, the ratio of the extension (a1) of the flow channels of the partial helices in a circumferential direction with respect to adjoining circumferential sections (a2), without flow channels, is formed so that $0.2 \leq a1/(a1+a2) \leq 0.5$.

The disclosure further comprises a turbocompressor of radial design with a return geometry according to one of the above-described embodiment examples.

Other advantageous further developments of the disclosure are characterized in the dependent claims or are explained in more detail below with reference to the figures and together with a preferred embodiment of the disclosure.

DRAWINGS

The drawings described herein are for illustrative purposes only of selected embodiments and not all possible implementations, and are not intended to limit the scope of the present disclosure.

DETAILED DESCRIPTION

Figure 1:
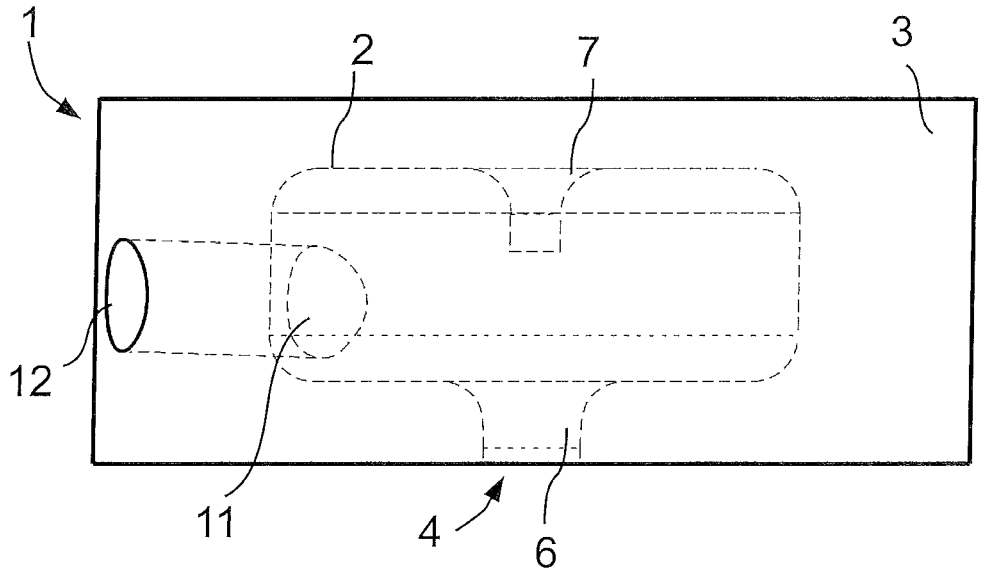
FIG. 1 is a diagrammatic view of a turbocompressor.

The figures are diagrammatic examples and used for a better understanding of the disclosure. Identical reference numerals designate identical parts in all the views.

In FIG. 1, a turbocompressor 1, a turbocompressor housing 3 and a spacer housing 2 accommodated therein are diagrammatically represented. On the spacer housing 2, at the flow inlet 4, a compressor impeller 6 of the first compressor stage is partially inserted in an axial opening. The compressor impeller 6 axially suctions a flowing fluid and blows it out radially in the direction of the second compressor stage. In the spacer housing 2, the compressor impeller 7, of the second compressor stage is arranged axially separated from the compressor impeller 6. The compressor impeller 7 also axially suctions the flowing fluid and blows it out radially in the direction of the outlet 11 of the spacer housing 2 and finally out of the outlet 12 of the turbocompressor housing 3.

The turbocompressor housing 3 and the spacer housing 2 provide a return geometry for fluidically connecting the first and second compressor stages with multiple partial helices arranged evenly distributed in a circumferential direction. This forms flow channels 5. The flow channels 5 extend separately from one another to establish the flow connection from the inlet region of the first compressor stage to the outlet region of the second compressor stage. This can be seen in the exploded representation according to FIGS. 2 and 3. The flow channels 5 in each case are generated by a channel clearance between the outer surface of the spacer housing 2 and the inner wall surface of the turbocompressor housing 3. Here, the geometry of the respective flow channels 5 can be determined by the two components, or else, for example, only by the spacer housing 2, as in the depicted case.

Figure 2:
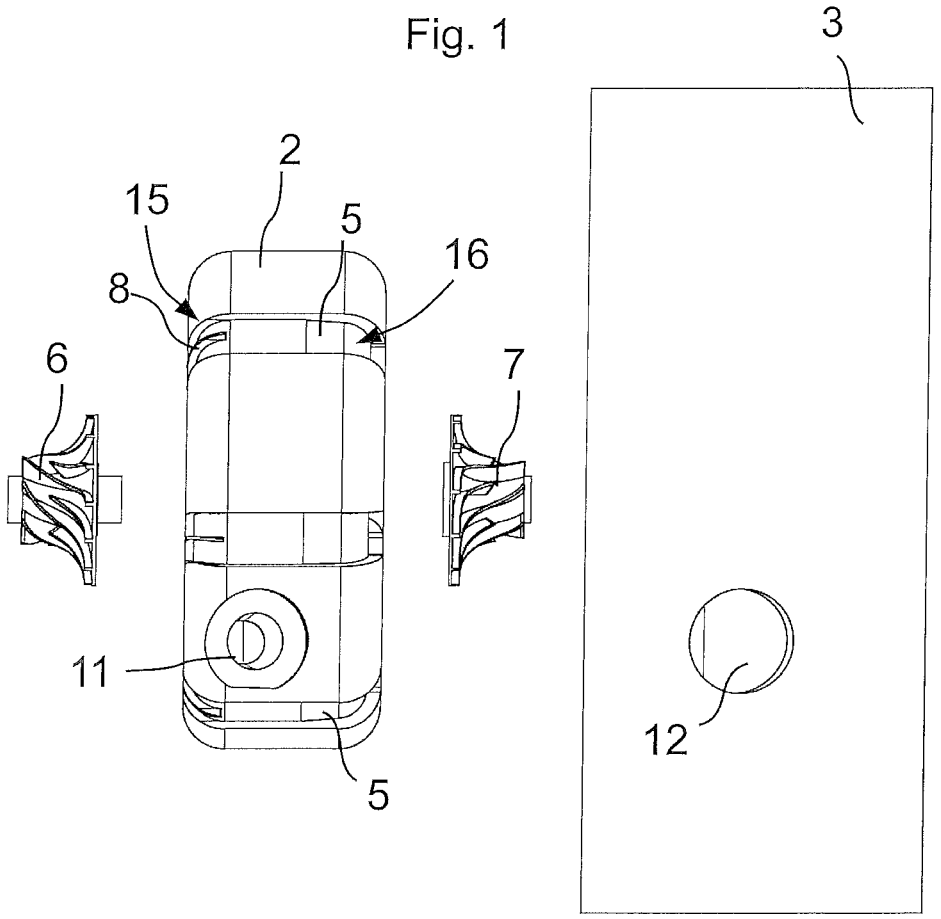
FIG. 2 is an exploded representation view of the parts of the turbocompressor from FIG. 1.
Figure 3:
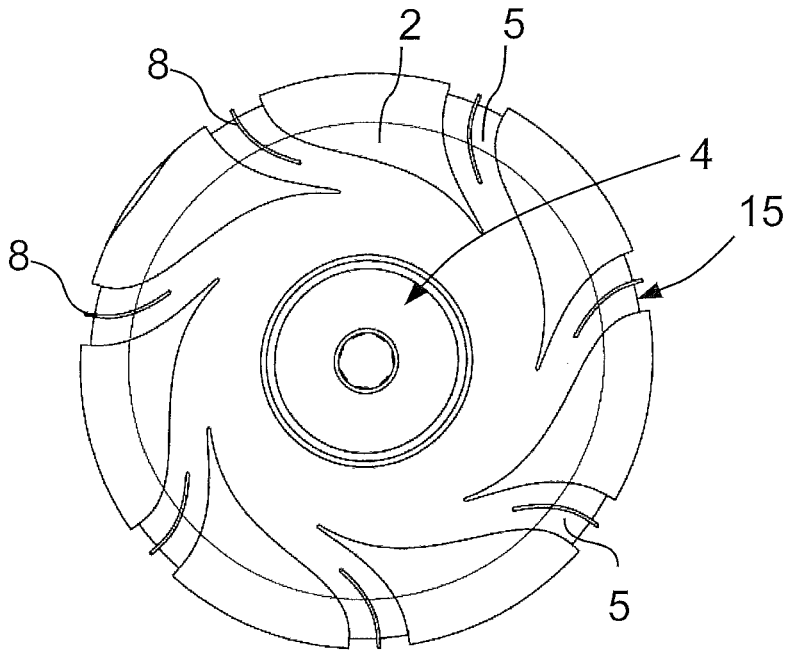
FIG. 3 is a top plan view onto a spacer housing from FIG. 2 with partial helices that form the flow channels.
Figure 4:
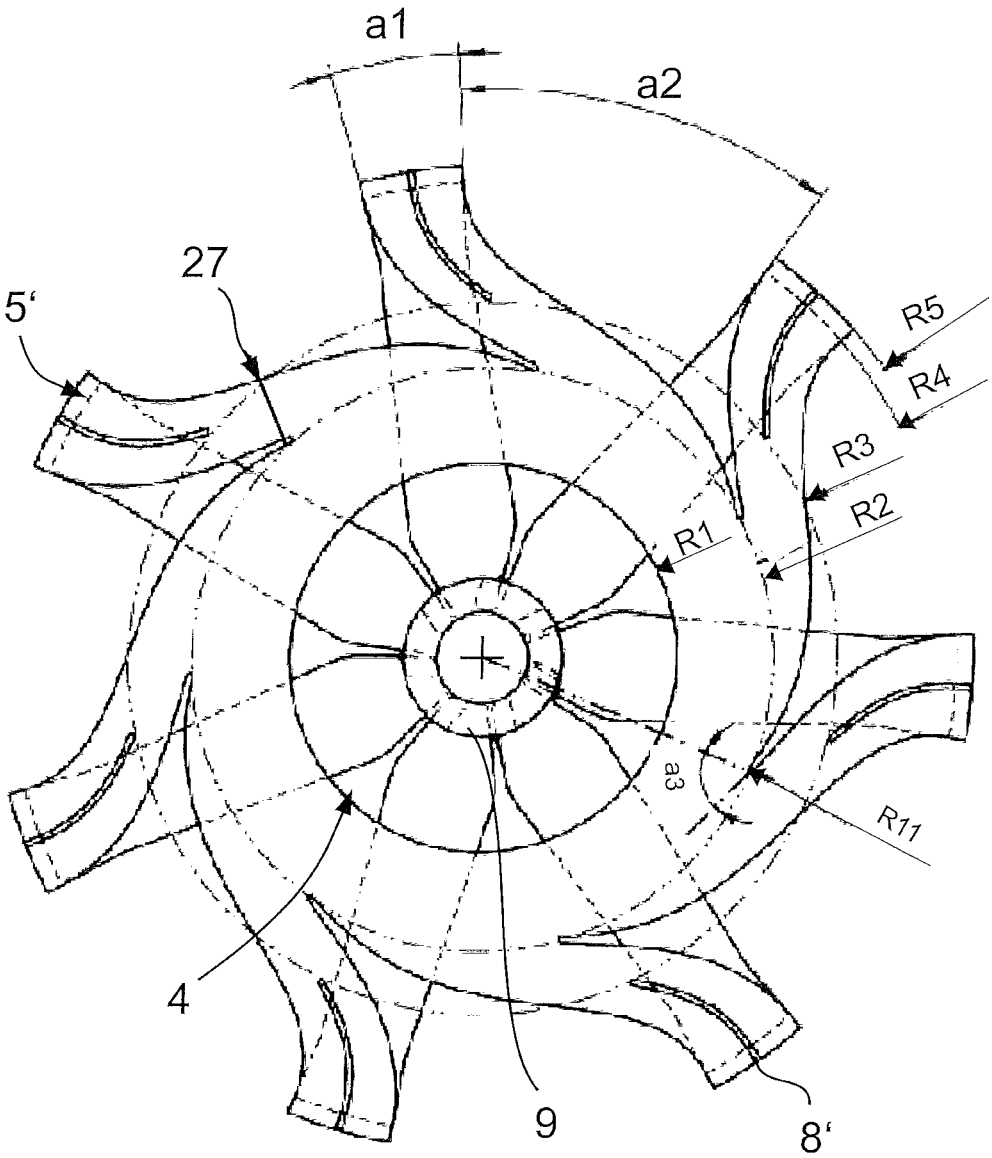
FIG. 4 is an inlet-side top view onto a diagrammatically represented flow geometry resulting from a flow course.
Figure 5:
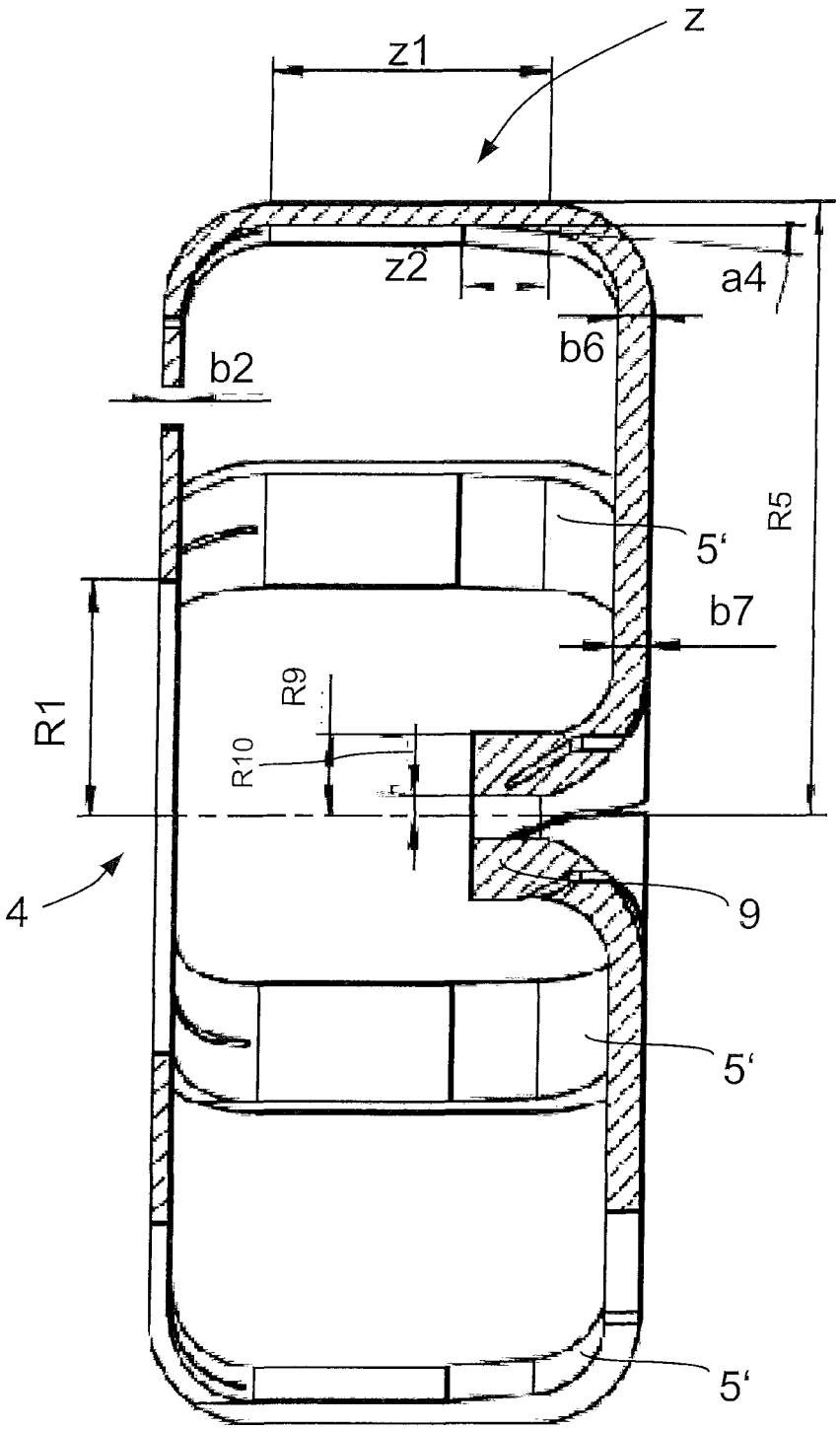
FIG. 5 is a lateral cross-sectional view of the flow geometry from FIG. 4.
Figure 6:
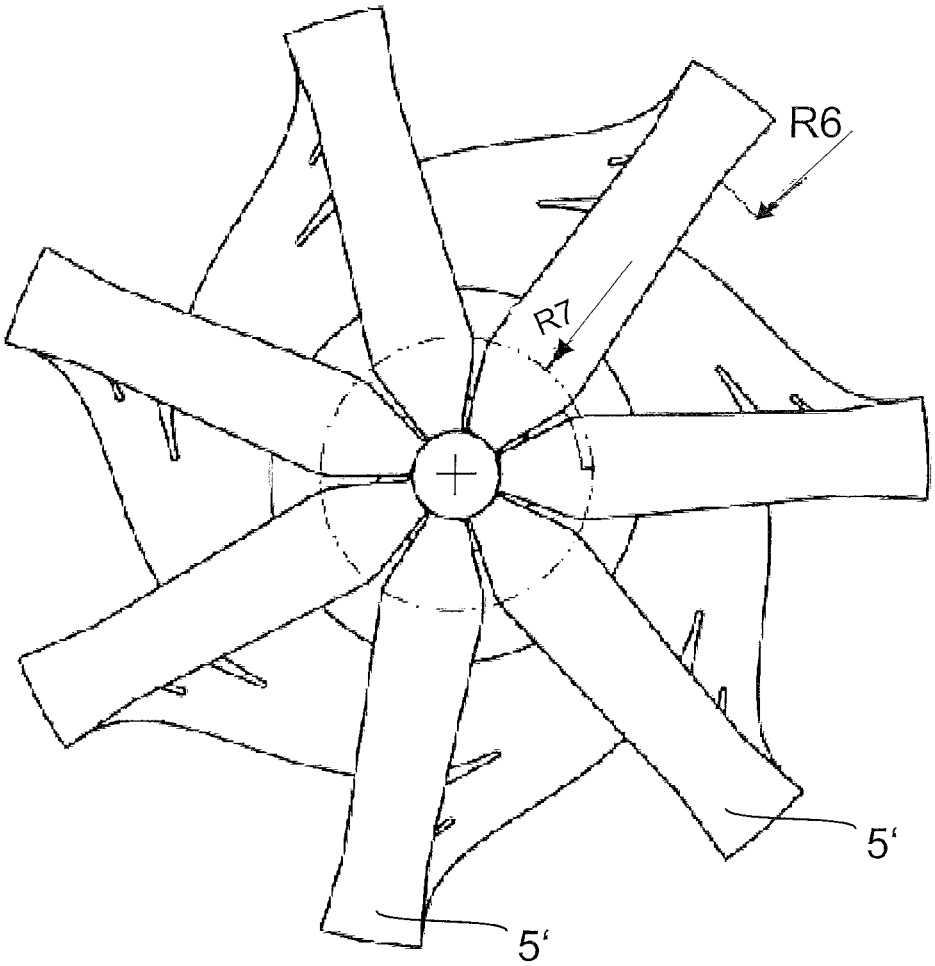
FIG. 6 is a back-side top view of the flow geometry from FIG. 4.
Figure 7:
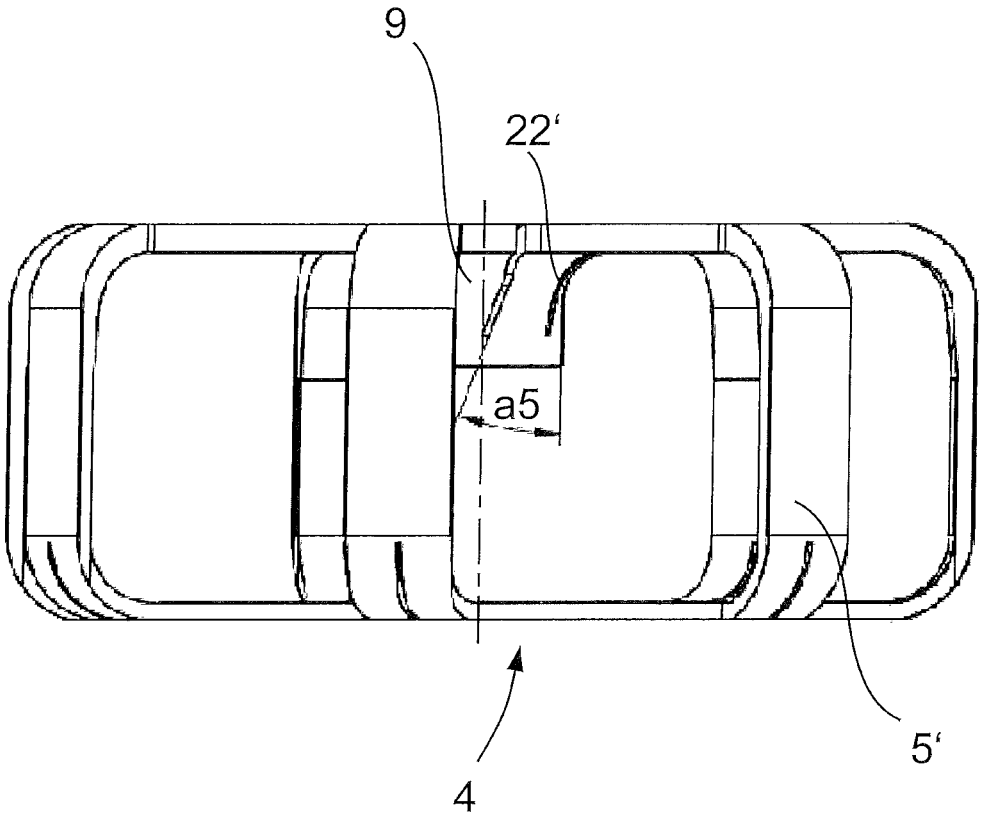
FIG. 7 is a side view of the flow geometry from FIG. 4.

In the embodiment represented in FIGS. 2 and 3, the return geometry for fluidically connecting the first and second compressor stages is generated by seven partial helices. Each one has an identical flow channels 5 extending from the flow inlet 4 radially outward and at the same time in a circumferential direction. The flow is multiply deflected by bends 15, 16 provided in the flow channels 5. In particular, the flow is deflected by the first bend 15, from a substantially radial outflow direction into a first axial direction in the direction of the second compressor stage. Subsequently, the second bend 16 deflects the flow back into the radial inflow direction that runs counter to the outflow direction. The third bend of the flow channels 5 is located within the spacer housing 2 and therefore cannot be seen. However, it guides the flow, subsequently to the inflow direction, into a second axial direction that runs counter to the first axial direction.

In each of the flow channels 5, a guide strut 8 is provided. The guide strut 8 extends in a radial and axial direction beyond the first bend 15. The guide strut 8 divides the flowing fluid in the center in the respective flow channel 5 during the first deflection.

The geometric design of the fluidic connection of the return geometry is represented in FIGS. 4-7. Based on the resulting flow geometry, in FIGS. 4-7, no components are shown. Instead, the geometric form of the return geometry is shown that enables free flow through it. The geometric form is shown that results from the design of the turbocompressor housing 3 and in particular of the spacer housing 2, and consequently the resulting flow from the first compressor stage to the second compressor stage. Therefore, the flow representing the form of the flow channels 5 is marked with 5' in FIGS. 4-7. The geometric form of the spacer housing 2 is designed so that the flow channels 5 extend from the inlet region of the flow inlet 4 of the first compressor stage to the outlet region of the first compressor stage. In the outlet region, the flow channels 5 extend to a circumferentially symmetrical overall channel 9. The channel 9 has a radius R9 and a central section, without through-flow, around the rotation axis with a radius R10.

The return geometry is subdivided into a number n of flow channels 5 (in the present case n=7) each with a circumferential extension a1. The intermediate regions without flow channels are marked with a2. The ratio a1/(a1+2) is set in the range of 0.2-0.5. In the depicted embodiment example, all the flow channels 5 have the same size and the same flow cross section. However, they can also have different designs from one another. Thus, for example, the length a1 of each flow channel or of some flow channels 5 varies, so that the $a1_1+a2_1 \neq a1_2+a2_2$ would apply.

In the transition to the overall channel 9, the individual flow channels 5 each have curved vortex struts that impart a vortex to the flow entering the overall channel 9. Thus, the flow at the outlet into the second compressor stage has a predefined vortex. The vortex struts, as negative image, are marked with reference numeral 22' in the flow shown in FIG. 7. They have an opening angle a5.

The flow channels 5 are designed in their axial section z. The flow is guided into the first axial direction in the direction of the second compressor stage, as a diffuser. They have a diffuser angle of a4. The condition $[R5(z)^2-R4(z)^2](a1\cdot\pi\cdot n)/360 \leq 2\cdot\pi\cdot R2\cdot b2$ is satisfied. Here R5 is the outer radius as a function of the axial coordinate z. R4 is the radius of the inner wall of the flow channel 5 as a function of the axial coordinate z. R2 is the tongue radius or outlet radius of the return geometry. b2 is the flow channel width in the outflow radial section. The diffusion ratio R2/R1 is set in a range of 1.4-1.8. After the tongue radius R2, the partial helices of the flow channels 5 follow with a tongue angle a3 between 60° and 80° with the tongue radius Rh as well as with a smallest surface 27 with through-flow at the inlet. The guide strut 8, mounted to improve the deflection, starts at R3>R2. Thus, the smallest surface with through-flow in the respective flow channel 5 is not narrowed further. The diffuser angle is formed in section z2 of the axial section z that determines a portion of the straight axial extension z1. The flow channel width b2, in the radial outflow direction section, is smaller than the flow channel widths b6 and b7 in the opposite radial inflow direction section.

The radial deflection and merging of the flow 5' is designed so that, to the extent possible, the flow speeds are changed little or not at all. In the depicted embodiment example, the condition that $b6\cdot R6\cdot a1/360\cdot n=b7\cdot R7$ is therefore satisfied. Here, b6 is the flow channel width adjoining the second bend 16 with radius R6. b7 is the flow channel width immediately before the third bend with radius R7, according to FIG. 6.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A turbocompressor return geometry fluidically connecting a first and a second compressor stage of the turbocompressor, the return geometry comprises:

multiple partial flow channels are arranged evenly or unevenly distributed in the circumferential direction, the multiple partial flow channels extend at least in part in the circumferential direction and the multiple partial flow channels extending at least in some sections separately from each other for fluidically connecting the first and second compressor stages;

the flow channels extend from an inlet region that can be associated with the first compressor stage to an outlet region that can be associated with the first compressor stage and merge in the outlet region to form a circumferentially symmetrical overall channel; and in a transition to the overall channel, the individual flow channels in each case includes curved portions and curved struts, on the curved portions, extending from the curved portions into the flow channels that are designed to impart a vortex to the flow as it enters the overall channel, so that the flow at the outlet region into the second compressor stage has a predefined vortex.

2. The return geometry according to claim 1, wherein the flow channels form multiple successively arranged bends that multiply deflect the flow between the first and second compressor stages.

3. The return geometry according to claim 2, wherein the bends of the flow channels guide the flow from a radial outflow direction into a first axial direction in the direction of the second compressor stage and subsequently back into a radial inflow direction that runs counter to the outflow direction.

4. The return geometry according to claim 3, wherein, subsequently to the inflow direction, one of the bends of the flow channels guides the flow into a second axial direction that runs counter to the first axial direction.

5. The return geometry according to claim 4, wherein, after the bends that guide the flow into the second axial direction, the flow channels merge in flow direction to form the overall channel.

6. The return geometry according to claim 3, wherein the bend formed in each case in the flow channels, that deflects the flow from the radial outflow direction into the first axial direction in the direction of the second compressor stage, in each case has a guide strut that extends along the respective flow channel in a radial direction outward and into the first axial direction.

7. The return geometry according to claim 3, wherein the flow channels in which the flow is guided into the first axial direction in the direction of the second compressor stage, have an axial section, and the axial section of the flow channels is designed as a diffuser.

8. The return geometry according to claim 1, wherein a spacer housing of the turbocompressor that separates the first compressor stage from the second compressor stage.

9. The return geometry according to claim 8, wherein the flow channels are formed by the spacer housing and a turbocompressor housing, the flow channels are formed by a channel clearance between an outer surface of the spacer housing and an inner wall surface of the turbocompressor housing.

10. The return geometry according to claim 8, wherein the spacer housing has an axial opening for receiving the compressor impeller of the first compressor stage with an axial opening radius R1, and the flour channels extend starting from a tongue radius R2 of the spacer housing, the tongue radius is greater than the axial opening radius R1 by the factor of 1.4-1.8.

11. The return geometry according to claim 10, wherein the flow channels extend radially outward in the circumferential direction at an inlet of the flow channels, that is determined by the tongue radius R2, at an angle a3=60°-80° with respect to a radial plane.

12. The return geometry according to Claire 13, wherein a ratio of the extension (a1) of the flow channels in circumferential direction with respect to adjoining circumferential sections (a2) without flow channels is formed so that $0.2 \leq a1/(a1+a2) \leq 0.5$.

13. The return geometry according to claim 1, wherein at least two of the flow channels for fluidically connecting the first and second compressor stages have a different overall flow cross section.

14. A turbocompressor of radial design with a return geometry fluidically connecting a first and a second compressor stage of the turbocompressor, the return geometry comprises:

multiple partial flow channel arranged evenly or unevenly distributed in the circumferential direction, the multiple partial flow channel extend at least in part in the circumferential direction and the multiple partial flow channels extending at least in some sections separately from each other for fluidically connecting the first and second compressor stages;

the flow channels extend from an inlet region that can be associated with the first compressor stage to an outlet region that can be associated with the first compressor stage and merge in the outlet region to form a circumferentially symmetrical overall channel; and in a transition to the overall channel, the individual flow channels in each case includes curved portions and curved struts, on the curved portions, extending from the curved portions into in the flow channels that are designed to impart a vortex to the flow as it enters the overall channel, so that the flow at the outlet region into the second compressor stage has a predefined vortex.

* * * * *